United States Patent [19]

Sturwold et al.

[11] Patent Number: 5,001,013

[45] Date of Patent: Mar. 19, 1991

[54] COATING OIL HAVING IMPROVED ELECTROCOAT COMPATIBILITY

[75] Inventors: Robert J. Sturwold, Cincinnati, Ohio; George E. F. Brewer, Birmingham, Mich.

[73] Assignee: Cincinnati-Vulcan Company, Cincinnati, Ohio

[21] Appl. No.: 394,379

[22] Filed: Aug. 15, 1989

[51] Int. Cl.[5] ..... B32B 15/04; C04B 9/02

[52] U.S. Cl. ..... 428/467; 106/14.13; 106/14.28; 106/14.29; 106/14.41; 252/49.5; 252/51.5 R; 252/52 R; 428/469; 428/470; 428/471

[58] Field of Search ..... 428/457, 467, 469, 470, 428/471; 252/51.1 R, 51.5 R, 52, 49.5; 106/14.41, 14.28, 14.29, 14.13

[56] References Cited

U.S. PATENT DOCUMENTS

| | | | |
|---|---|---|---|
| 3,298,954 | 1/1967 | Brown | 252/51.1 R |
| 3,600,310 | 8/1971 | Eyres et al. | 252/49.5 |
| 3,857,789 | 12/1974 | Krupin et al. | 252/52 R |
| 4,166,151 | 8/1979 | Jahnke | 428/457 |
| 4,650,526 | 3/1987 | Claffey et al. | 428/470 |
| 4,656,097 | 4/1987 | Claffey et al. | 428/469 |

*Primary Examiner*—Thomas J. Herbert, Jr.

[57] ABSTRACT

Coating oil compositions are provided which contain an oil-soluble metal petroleum sulfonate, an oxidate ester, an organic acid ester, and a hydrocarbon oil. The coating oils are highly effective for preventing rust and corrosion of both ferrous and non-ferrous metals but are particularly advantageous for application to metal sheet which is subsequently to be electrocoated. Coating oils formulated in accordance with the present invention exhibit improved electrocoat compatibility.

19 Claims, No Drawings

COATING OIL HAVING IMPROVED ELECTROCOAT COMPATIBILITY

BACKGROUND OF THE INVENTION

1. Field of the Invention

The present invention relates to improved coating oil compositions for application to metal surfaces to protect the metal from rust and corrosion. More particularly, the coating oils of this invention are employed for the treatment of metal surfaces which are subsequently electrocoated and exhibit improved compatibility with the paint used in the electrodeposition process.

2. Description of the Prior Art

The need to protect the surface of metal sheet obtained from rolling operations, particularly the surfaces of ferrous metals, is recognized throughout the industry and a variety of coating oil compositions are available for this purpose. The coating oil is typically applied to the metal after final processing and before storage or shipment to protect the metal surface. It should also protect the metal from rust and corrosion during storage and shipment.

It is not uncommon for metal coils to be stored for prolonged periods prior to stamping and other metal working operations, often in hostile environments. For example, the coils may be subjected to a high humidity, wide temperature variations and acidic atmospheres from adjacent pickling baths, all of which promote rust and corrosion. The coating oil should prevent or at least minimize deterioration of the metal surface resulting from these conditions.

While the coating oil must be capable of forming a tenacious, continuous, hydrophobic barrier on the metal surface, it should not interfere with subsequent surface treatments, most notably, phosphatizing and painting. It must be capable of being readily and completely removed in subsequent annealing and/or washing operations so that it will not adversely affect adhesion or surface quality of the paint film. This is even more critical where the paint is applied by electrocoating.

Electrodeposition of paint, i.e. electrocoating, is commonly used for industrial painting of metal workpieces. The ability to deposit paint films in recessed areas coupled with the ability to use water-based paints and other advantages associated therewith have resulted in wide acceptance and use of electrodeposition processes by automobile and other manufacturers, notably by the appliance industries, to paint individual body parts and entire car bodies or other assemblies. For a general description of electrodeposition procedures, reference may be had to Kirk-Othmer Encyclopedia of Chemical Technology, 3rd Ed., vol. 15, pp. 178–191 (John Wiley and Sons).

If coating oil residues are present on the metal workpiece being electrocoated, there residues can build up in the electrocoating dip tank and ultimately will result in surface imperfections in the cured paint film. These imperfections resemble small indents, streaks or other blemishes. A similar problem can occur if coating oils are trapped in areas such as seams, joints, etc., and can not be washed out prior to electrocoating. The trapped coating oil will be volatilized during the curing (baking) and can settle out on adjacent painted surfaces also causing formation of blemishes.

Accordingly, in formulating coating oils suitable for treating metal surfaces which are subsequently to be electrocoated, the formulations must not only prevent rust and corrosion but also must not interfere with the subsequent electrocoated film.

Numerous coating oils are known and reported in the literature to protect metal surfaces against rust and corrosion. Typically these products form a continuous, hydrophobic barrier on the metal surface which is impervious to moisture. Some are also effective against the corrosive action of acidic vapors. Most of these products comprise a carrier oil with a waxy and/or fatty substance and, optionally, one or more additives. U.S. Pat. No. 3,298,954, for example, describes compositions containing polybutenes, fatty acids, and in some cases sperm oil wax. The lubricant compositions of U.S. Pat. No. 3,600,310 which are disclosed for the protection of metal surfaces during coiling and uncoiling contain a mineral oil, a fatty acid or polymer or glyceride thereof, and a paraffin wax such as slack wax.

U.S. Pat. No. 4,166,151 discloses "waxy" ester compositions useful for protecting metal surfaces from acidic vapors which are derived from $C_{10-25}$ aliphatic carboxylic acids and $C_{15-40}$aliphatic alcohols. These wax esters can be applied to the metal in an inert, volatile hydrocarbon. Coating oils which are blends of a petroleum sulfonate, a polymeric fatty acid and a hydrocarbon oil are described in U.S. Pat. No. 4,396,515. More specifically, the coating coil compositions are comprised at 1–15% polymeric fatty acid obtained from the polymerization of an unsaturated $C_{16-20}$ monocarboxylic acid and containing at least 60% $C_{36}$ dimer, 1–15% oil soluble Group IA alkali metal petroleum sulfonate, and 80–98% inert, substantially wax-free, naphthenic or paraffinic hydrocarbon oil. Slushing oil or rust inhibiting compositions comprised of a Group IIA, IIIA or IVA metal salt of a mahogany or naphthalene sulfonic acid, an aliphatic carboxylic acid, a cosolvent selected from aromatic hydrocarbons, methyl pyrrolidone, tetrahydrofuran and mono- and dialkyl ethers of alkylene glycols and mixtures thereof, and a paraffinic or naphthenic lubricating oil are disclosed in U.S. Pat. No. 3,875,789.

Whereas all of the formulations of the above references are effective for preventing corrosion of ferrous metals and in some instances are effective against the action of acidic vapors, they are all unsuitable for use where a metal workpiece formed from metal sheet coated with said oils is subsequently electrocoated. They all interfere to a greater or lesser extent with the electrodeposition process and produce undesirable and aesthetically unacceptable paint films.

SUMMARY OF THE INVENTION

In accordance with the present invention there are now provided coating oil compositions which exhibit improved compatibility in electrodeposition processes. Quite unexpectedly I have discovered that the present coating oils not only effectively prevent rust and corrosion but also minimize, and in some cases completely eliminate, problems associated with the deposition of paint films in subsequent electrocoating operations.

The present coating oil compositions are highly useful for coating both ferrous and non-ferrous metals to protect the surface of the metal from the corrosive action of acidic vapors and moisture during storage and shipment. These oils form a continuous, impervious, lubricious, hydrophobic barrier on the surface of the metal which additionally protects the surface from scratching during coiling and uncoiling operations. The compositions of this invention are particularly useful for application to metal sheet which is subsequently used to form a workpiece which is to be painted by electrocoating. Residues of the present coating oils which remain on the metal workpiece after cleaning or which inevitably build up in the electrocoating dip tank during continuous operation have surprisingly been found to have very little effect on the surface qualities of the resulting cured electrodeposited films. Paint films applied to metals which have been coated with coating oil formulations of this invention are essentially free of surface imperfections.

In their most general terms, the coating oils of this invention are comprised of an oil-soluble metal sulfonate, an oxidate ester, an organic ester, and a hydrocarbon oil. More specifically the coating oils are comprised of (a) 2 to 10 weight percent oil-soluble Group IA alkali metal or Group IIA alkaline earth metal petroleum sulfonate; (b) 2 to 10 weight percent of a partially neutralized oxygenated hydrocarbon; (c) 0.5 to 6 weight percent of an organic acid ester selected from esters of mon-nuclear aromatic acids having from 1 to 3 carboxyl groups and esterified with mono-functional aliphatic alcohols having from 1 to 20 carbon atoms and esters of short-chain aliphatic dicarboxylic acids having from 4 to 10 carbon atoms and esterified with a mono-functional aliphatic alcohol having from 1 to 12 carbon atoms; and (d) 80 to 95.5. weight percent inert, substantially sulfur-free hydrocarbon oil having a 100° F. viscosity of 50 to 500 SUS. Highly useful compositions are those wherein the petroleum sulfonate (a) is based on sodium, barium or calcium and the oxidate ester (b) is a calcium or barium soap. In one especially useful embodiment 6 to 10 weight percent of a metal sulfonate/oxidate ester blend wherein the metal is sodium, calcium, barium or mixtures thereof is employed. Naphthenic and paraffinic oils having viscosities of 75 SUS to 350 SUS are preferably used to formulate the coating oils. More commonly the acid esters (c) employed for preparation of the coating oils are esters derived from a mono-nuclear aromatic acid selected from benzoic acid, o-phthalic acid and trimellitic acid and an aliphatic alcohol having from 2 to 13 carbon atoms or an ester derived from an aliphatic dicarboxylic acid having from 6 to 9 carbon atoms and an aliphatic alcohol having from 6 to 10 carbon atoms. Particularly effective coating oils exhibiting excellent rust and corrosion protection and superior electrocoat compatibility are formulated using alkyl esters of o-phthalic acid or adipic acid.

DETAILED DESCRIPTION OF THE INVENTION

Petroleum sulfonates useful for the compositions of the present invention are the oil-soluble Group IA alkali metal or Group IIA alkaline earth metal sulfonates derived from petroleum fractions or their synthetic substitutes obtained by known manufacturing procedures and which are commercially available from a variety of suppliers. The molecular weight and the nature of the hydrocarbon and cation portions of the molecule can vary and are primarily governed by the requirements of the application and compatibility with the other components used. Typical oil-soluble petroleum sulfonates correspond to the general formula $(C_nH_{2n-10}SO_3)_xMe$ where Me represents the alkali or alkaline earth metal, most usually lithium, sodium, potassium, calcium or barium, n is an integer greater than 20, and x is 1 or 2 and is equal to the valence of the metal. Sodium, calcium and barium petroleum sulfonates are particularly useful for the formulation of the coating oils of the present invention. Mixed metal petroleum sulfonates can also be advantageously employed. Such petroleum sulfonates are commercially available as solutions in a variety of hydrocarbon oils and typically contain 50–80% of the active ingredient. For example, products manufactured by King Industries and sold under the trademark NA-SUL are useful in the formulation of coating oils of this invention.

Metal soaps, and particularly the barium soap, of dinonylnaphthalene sulfonic acid (obtained by the controlled alkylation of naphthalene with nonene followed by direct neutralization with appropriate metal salt) are highly useful. In one embodiment of the invention the coating oils are formulated using a barium salt of dinoylnaphthalene sulfonic acid and it is even more advantageous if the barium salt is neutralized barium salt. These latter products are sold under the trademark NA-SUL BSN and are available with a variety of diluents (including synthetic hydrocarbon fluids). They are also available with oxidate esters as the diluent which will be described in more detail later in this description.

A partially neutralized oxygenated hydrocarbon is also required for the formulation of the present improved coating oil compositions. These products, sometimes referred to by the industry and herein as oxidate esters, are obtained by neutralizing oxygenated hydrocarbons obtained by the controlled, liquid phase, partial oxidation of petroleum fractions. Such processes are known and widely practiced within the petroleum industry. The oxygenated hydrocarbons, which can vary in molecular weight and degree of oxidation depending on the particular petroleum fraction used and the process conditions, are complex mixtures of organic acids, oxy-acids, esters, lactones and unsaponifiables and undergo all the reactions typically associated with these moieties. For the purpose of obtaining the coating oils of this invention, the oxygenated hydrocarbons are partially converted to metallic soaps. Oxidate esters which are useful include the sodium, calcium and barium soaps of the oxygenated hydrocarbons. Calcium and barium oxidates are particularly effective for the present invention.

Useful oxidate esters will generally contain from 0.8% to 48.8% (by weight) of the metal and have an acid number (ASTM D74-52) in the range 0.1 to 60. More commonly the metal content will range from 2.1% to 36.6% and the acid value will be from 2 to 40, Saponification values of the oxidate esters typically range from 20 to 200, and most generally, are between 50 and 150. These products are commercially available from a variety of suppliers. ALOX Corporation markets several useful products including ALOX 162, ALOX 165 and ALOX 350.

As previously mentioned, there are available from certain manufacturers blends of partially neutralized oxygenated hydrocarbons and metal petroleum sulfonates which can be utilized to prepare the instant improved coating oil compositions. ALOX Corporation and R. T. Vanderbilt Co., Inc. are two known suppliers of such products, referred to hereinafter as metal sulfonate/oxidate blends. These blends may be based on mixed metals or the metal associated with the sulfonate and the metal associated with the oxidate ester may be the same. For the purpose of this invention, the metal(s) for the sulfonate/oxidate blend will be any of the metals hereinabove defined for the individual components but, most preferably, sodium, calcium, barium or mixtures thereof. The ratio of the sulfonate and oxidate comprising the blend may vary from 3:1 to 1:3 but, most preferably, ranges from 2:1 to 1:2. The blends may in some instances contain a diluent but this is not necessary. Representative commercial blends which can be used include ALOX 940A, ALOX 2278, ALOX 2289, NA-SUL BSN/W960-X, NA-SUL BSN/W930-S and NA-SUL CA/W1745. ALOX 2278 and NA-SUL BSN/W930-S available from ALOX Corporation and R. T. Vanderbilt Co., Inc., respectively, are highly effective blends for the formulation of the coating oils.

Select esters are necessarily included with the metal sulfonate and oxidate ester to obtain coating oils which exhibit improved electrocoating compatibility. Useful esters for the present invention are esters of mono-nuclear aromatic acids and esters of aliphatic dicarboxylic acids. The carboxyl moieties of the acids are substantially completely esterified.

The aromatic esters are derived from aromatic acids which are mono-nuclear and which have from 1 to 3 carboxyl groups substituted on the ring. Useful aromatic acids of this type include but are not limited to benzoic acid, the phthalic acids, and trimellitic acid. The aromatic ring may contain additional substituents which do not interfere with ester formation or the effectiveness of the resulting ester in the coating oil formulation. The presence of additional substituents, primarily lower alkyl substituents, is most generally limited to the di-COOH and, more particularly, the mono-COOH products. The aromatic acids are esterified with a mono-functional aliphatic alcohol having from 1 to 20 and, more preferably, from 2 to 13 carbon atoms. The alcohols may be branched or straight-chain and may be primary or secondary alcohols. Mixtures of alcohols which satisfy the above requirements are equally effective. In a highly useful embodiment of the invention, $C_{2-13}$ alkyl esters of benzoic acid, o-phthalic acid and trimellitic acid are employed. $C_{2-13}$ alkyl esters of o-phthalic acid have been found to be particularly useful aromatic esters for the preparation of highly effective coating oils. For the purpose of this invention the o-phthalic acid can contain only the o-isomer or mixtures wherein the o-isomer is the predominant isomer.

Useful aliphatic esters are derived from short-chain dicarboxylic acids having from 4 to 10 and, more preferably, 6 to 9 carbon atoms. Representative acids include succinic acid, glutaric acid, adipic acid, pimelic acid, azelaic acid, sebacic acid, and the like. Alcohols employed to esterify the aliphatic dicarboxylic acids are mono-functional aliphatic alcohols having from 1 to 12 carbon atoms. $C_{6-10}$ aliphatic alcohols are particularly useful. $C_{6-10}$ alkyl esters of adipic acid are particularly useful aliphatic esters for the preparation of highly effective coating oil compositions.

For effective application to the metal surface, the metal sulfonate, oxidate ester and organic acid ester are dissolved in an inert hydrocarbon diluent or carrier oil. Useful hydrocarbon oils for this purpose are any of the commonly used naphthenic, paraffinic or synthetic oils which are substantially inert and substantially sulfur-free and which have viscosities from 50 to 500 SUS at 100° F. Naphthenic and paraffinic oils of 75 to 350 SUS (100° F.) are especially useful. Whereas the foregoing viscosities are specified in Saybolt Universal Seconds, it will be understood that this data can be readily converted to other viscometric units, e.g. kinematic viscosities in centistokes, by referring to available conversion tables. One such chart for determining equivalent viscosities at 100° F. is found at page 36 of "The Lubrication Manual", First Edition (1971), published by the U.S. Steel Corporation. Thus, by way of example, the upper viscosity limit of the hydrocarbon oils used for the preparation of the present improved coating oil compositions, represented in centistokes is approximately 108.

The viscosity of the hydrocarbon(s) to be used is dictated primarily by the method of application, i.e. whether the coating oil is to be sprayed, wiped, rolled or brushed onto the surface of the metal or whether the metal is to be immersed in a bath containing the oil, etc. Hydrocarbon oils with viscosities in the range 75 to 350 SUS are most useful for the majority of applications and are therefore particularly advantageous. By judicious blending, however, individual hudrocarbon oils having viscosities greater than those specified can be used in blends so long as the viscosity of the resulting hydrocarbon blend is within the ranges prescribed above.

By the terms "substantially inert" and "substantially sulfur-free" is meant that the hydrocarbon oil does not chemically react with the metal surface or otherwise impair the efficiency of the active components. The hydrocarbon oil should have a vapor pressure such that it can evaporate under ambient conditions leaving a continuous protective coating of the surface of the metal.

Paraffinic oils and naphthenic oils suitable for the coating oils of this invention are readily available from commercial suppliers. Especially useful hydrocarbons are the solvent extracted "de-waxed" oils which typically have sulfur contents of 0.5% or lower. Synthetic hydrocarbon oils obtained by oligomerizing olefins having up to 20 carbon atoms, e.g. decene-1, in the presence of peroxide or Friedel-Crafts catalysts can also be employed. Coating oil compositions exhibiting superior characteristics are obtained using 105 SUS naphthenic oil or a hydrocarbon oil blend where the 105 SUS naphthenic oil is the major component oil.

As was pointed out previously, it will be understood that mixtures of hydrocarbon oils are equally satisfactory for the practice of this invention, in fact, it is sometimes advantageous to utilize blends of two or more petroleum and/or synthetic hydrocarbons. This is particularly advantageous for the user since he can "customize" the coating oils to fit his particular needs. Also, this feature makes it possible for the supplier to provide a multi-purpose coating oil "concentrate" which can later be diluted to suit the needs of the user. The compositions of this invention are particularly suited for preparation of concentrates since the metal sulfonates, oxidate esters and organic acid esters are all readily soluble in the hydrocarbon oils at high concentrations.

For preparation of the coating oil formulations, the metal sulfonate, oxidate ester and organic acid ester are added, individually or in combination, to the hydrocarbon oil or hydrocarbon oil blend and are readily soluble therein without special processing. Conventional mixing with a pump or agitator is sufficient to effect solution and the resulting solutions are stable and do not deteriorate or separate under ambient conditions even when stored for prolonged periods. Additives such as stabilizers, fungicides, bacteriocides or the like may be included in small amounts; however, they are not necessary for most applications.

The coating oils will typically contain from 2 to 10 weight percent oil-soluble metal petroleum sulfonate, 2 to 10 weight percent oxidate ester, 0.5 to 6 weight percent organic acid ester, and 80 to 95.5 weight percent hydrocarbon oil. Particularly useful compositions contain 2.5 to 6 weight percent of the oil-soluble metal petroleum sulfonate, 2.5 to 6 weight percent of the oxidate ester, 1 to 5 weight percent of the organic acid ester, and 85 to 92 weight percent of the hydrocarbon carrier.

In one highly useful embodiment of this invention $C_{2-13}$ alkyl esters of o-phthalic acid are employed for the coating oil formulation in amounts ranging from 1 to 4 weight percent. In yet another embodiment $C_{6-10}$ alkyl esters of adipic acid are employed in amounts ranging from 2 to 5 weight percent. In still another embodiment, 6 to 10 weight percent of a commercially available sodium sulfonate/calcium oxidate blend, ALOX 2278, is employed with 1 to 4 weight percent $C_{2-13}$ alkyl ester of o-phthalic acid or 2 to 5 weight percent $C_{6-10}$ alkyl ester of adipic acid and 86 to 93 weight percent 105 SUS naphthenic oil.

Manufacturer specifications for ALOX 2278 are as follows:

| | |
|---|---|
| Acid Number (ASTM D 974) | 4–8 |
| Saponification Number (ASTM D-94) | 60–75 |
| Melting Point °F. (ASTM D-127) | 95 ± 5 |
| Flash and Fire Points (O.C.) °F. (Min.) | 250 |

Especially useful coating oil formulations of this invention have viscosities of 75 to 300 SUS and acid values of 0.5 to 10.

While the present coating oils have general utility, i.e., they are useful in any application where the surface of the metal requires protection from rust and corrosion, they are particularly useful in those applications where the metal sheet is to be formed by stamping or the like into a workpiece which is subsequently painted by electrocoating. The present compositions are primarily useful as coatings for ferrous metals; however, they may also be advantageously used with non-ferrous metals, such as aluminum, aluminum alloys and the like. While non-ferrous metals do not rust, they are susceptible to corrosion (used here in the general sense to encompass all forms of surface deterioration resulting from the action of oxygen or other deleterious materials) and can benefit from the application of coating oils. This would also encompass phenomena such as staining resulting from contact with water, acidic vapors and the like. In general, the products of this invention can be used in any application which requires the deposition of a continuous, impervious protective barrier and/or a continuous, lubricious film on the surface of the metal.

The primary advantage of these coating oils, however, is their ability to be used on metal surfaces which are subsequently to be electrocoated. Heretofore known coating oil compositions, all of which provide varying degrees of lubrication and rust and corrosion protection, are inadequate with regard to their ability to produce a high quality cured paint film which is uniformly free of surface defects. Even though the surfaces of the metal workpiece are cleaned to remove these coating oils and other impurities from prior metalworking operations, residues can still remain. Even low concentrations of these residues can adversely affect adhesion of the paint film or the quality of the resulting finish. This is particularly true where the paint film is applied by electrocoating.

Various industries are a large consumer of coated metal sheet which is subsequently stamped into parts and then electrocoated, either individually or after complete or partial assembly. Coating oils used on metal sheet designated for use by these industries must therefore meet the additional performance requirements imposed by these manufacturers. One such requirement is compatibility of the electrocoat pain with the oil. As used herein the term paint is used to encompass any water-borne or solvent-bore organic film-forming material, e.g. cathodic acrylics, anodic acrylics, cathodic or anodic epoxies, etc., including primer coats and finish coats.

With the extended warranties against rust and perforation now being offered throughout the auto industry, every effort is being made by automobile manufacturers to eliminate defects in the cured paint films since this is frequently the point of origin of subsequent rust and perforation problems. This has prompted numerous improvements in paint films and electrodeposition procedures. With regard to the latter, there has been a concerted effort to eliminate impurities on the metal surface since studies have shown that even minor traces of mill oils, drawing compounds and other lubricants can result in imperfections in the resulting cured electrocoated paint film. Since as a practical matter is not possible to remove every trace of these deleterious materials from the workpiece, especially a workpiece which contains recesses, seams and joints, there has been increasing emphasis on the development of products which are effective for the specified purpose but which have a reduced tendency (or preferably eliminate) the associated problems in the electrocoating operation.

Additional and more stringent tests have accordingly been developed by the automobile manufacturers in an effort to effectively screen products such as coating oils. One such test developed by General Motors Corp., Fisher Body Division, is the Electrocoat Primer Compatibility Test TM55-55, sometimes referred to as the "Elpo" test. This two-part test evaluates the compatibility of electrocoat primers with various lubricant products, including, but not limited to rolling oils, coating oils and drawing compounds.

One part of the TM55-55 test, referred to as the "soak and coat test", is used to evaluate the tendency of the coating oil to produce craters in the electrocoat film and is intended to simulate a system in which the electrocoat bath becomes contaminated with the coating oil. Such contamination can occur in continuous electrocoating operations due to the presence of trace amounts of coating oils on the workpiece in spite of phosphate and/or chromate pretreatment of the metal workpiece. For this test, a small amount of the coating oil is added to the electrocoat material and the mixture stirred before electrocoating metal test panels. The test panels are then baked and visually inspected for craters and rated.

Another part of the TM55-55 test tests for cratering from atomized oils. The effect of coating oil on the surface of the paint film is evaluated. In this procedure, also referred to herein as the "sandwich test", cratering caused by coating oil which is boiled out or atomized during the baking and which settles on the adjacent film surfaces is rated. This situation occurs where coating oil is trapped in recesses, seams and joints and is not completely washed out by pretreatment prior to electrocoating. For this test, a thin film of coating oil is sandwiched between two metal test panels which are then electrocoated, baked, visually inspected for craters and rated.

Specifics of the testing as well as other aspects of the invention will be more fully explained in the following examples. These examples are provided for illustration only and are not intended to limit the invention. Numerous variations within the scope of the invention are possible and will be apparent to those skilled in the art. All parts and percentages in the examples are on a weight basis unless otherwise indicated.

EXAMPLE I

A coating oil was prepared by blending 8 parts commercially available sodium sulfonate/calcium oxidate ester blend (ALOX 2278), 3 parts di-isodecyl o-phthalate, and 89 parts 105 SUS naphthenic oil (Exxon 1502). The resulting clear, amber coating oil had the following properties:

| | |
|---|---|
| Acid Value (mgKOH/g) | 0.5 |
| Saponification Value (mgKOH/g) | 9 |
| Viscosity (100° F.): | |
| Centistokes | 26 |
| SUS | 128 |
| Flash Point (°F.) | 330 |
| Specific Gravity (21° C.) | 0.909 |

The ability of the coating oil to prevent corrosion was demonstrated using the Corrosion Test for Sheet Metal Processing Lubricants developed by General Motors, Fisher Body Division (TM 52-29). For the test, three different types of test panels were cleaned (clean bare treatment with toluene rinse) and coated with the oil using a No. 6 R.D. Specialties Inc. drawbar. The coated panels were then exposed to 10 cycles in a humidity chamber (Singleton Model 22). Each cycle consisted of 16 hours of 100° F. and 100° F. and 100% relative humidity followed by 8 hours under ambient conditions. After each cycle the panels were examined for occurrence of pinpoint corrosion spots. Each panel was run in triplicate and compared with panels coated with a commercial coating oil and the results are reported in Table I. The coating oil of this invention gave results which were comparable to the commercial product for the hot-dipped galvanized and electrogalvanized panels and were superior to the commercial oil with the cold rolled steel panels. Whereas the commercial oil gave unacceptable results with the cold rolled steel after the 9th cycle, results with the cold rolled steel panels coated with the products of this invention were acceptable through the entire 10 cycles.

TABLE I

| | CORROSION CYCLE | | | | | | | | | |
|---|---|---|---|---|---|---|---|---|---|---|
| | 1 | 2 | 3 | 4 | 5 | 6 | 7 | 8 | 9 | 10 |
| Cold Rolled Steel[1]: | | | | | | | | | | |
| Example I Coating Oil | 0,0,0 | 0,0,0 | 0,0,0 | 0,0,0 | 0,0,1 | 0,0,1 | 0,0,1 | 0,0,1 | 0,0,1 | 0,0,1 |
| Commercial Coating Oil | 0,0,0 | 0,0,0 | 0,0,0 | 0,0,0 | 0,0,0 | 0,0,0 | 0,0,0 | 0,0,0 | *,*,6 | *,*,6 |
| Hot Dipped Galvanized[2]: | | | | | | | | | | |
| Example I Coating Oil | 0,0,0 | 0,0,0 | 0,0,0 | 0,0,0 | 0,0,0 | 0,0,0 | 0,0,0 | 0,0,0 | 0,0,0 | 0,0,0 |
| Commercial Coating Oil | 0,0,0 | 0,0,0 | 0,0,0 | 0,0,0 | 0,0,0 | 0,0,0 | 0,0,0 | 0,0,0 | 0,0,0 | 0,0,0 |
| Electrogalvanized[3]: | | | | | | | | | | |
| Example I Coating Oil | 0,0,0 | 0,0,0 | 0,0,0 | 0,0,0 | 0,0,0 | 0,0,0 | 0,0,0 | 0,0,0 | 0,0,0 | 0,0,1 |
| Commercial Coating Oil | 0,0,0 | 0,0,0 | 0,0,0 | 0,0,0 | 0,0,0 | 0,0,0 | 0,0,0 | 0,0,0 | 0,0,0 | 0,2,0 |

[1]4" × 6" ACT Unpolished Cold Rolled Steel
[2]4" × 6" GM 16-45E Hot Dipped Galvanized
[3]4" × 6" GM 19-90E Electrogalvanized
*More than 10 Spots Pinpoint Corrosion The product was evaluated for cratering using the Elpo test. For the soak and coat evaluation, 0.1 percent by volume of the coating oil was added to a gray cathodic electrocoat primer (PPG ED-3150A; 20% solids) and the mixture vigorously agitated for four hours. The primer was then transferred to a 1 gallon coating tank having a flat stainless steel (24sq. in.) anode connected to rectifier (Controlled Power Co. RXPO P-03-9856-86). A 4"×12"×0.032" phosphated metal test panel (ACT Cold-rolled steel, Unpolished. Chemfos 168) was then immersed in the electrocoat bath to a depth of 6 inches, connected to the power source, and electrocoated at 240 volts for 90 seconds. The coated panel was removed from the bath, rinsed with deionized water, air blown to remove droplets, and baked at 325° F. for 20 minutes in an electric, forced-air oven. The panel was then visually inspected for the presence of indents or craters on the paint film and rated using the following scale:

| Rating | Number of Craters |
|---|---|
| 5 | 0–2 |
| 4 | 3–8 |
| 3 | 9–15 |
| 2 | 16–25 |
| 1 | 25–35 |
| 0 | >35 |

Any product with a rating of 3 or lower is deemed to have failed the test and considered unacceptable. Panels coated with primer containing the above-prepared coating oil had a rating of 5 with no apparent craters formed on the electrocoated surface.

For the sandwich test, a 5 mil film of the coating oil was applied to the bottom half of a 4"×12"×0.032" phosphated metal test panel (ACT Cold-rolled steel, Unpolished, Chemfos 168) and covered with a 4"×6"×0.032" panel of the same metal and clipped together using two jumbo-size paperclips. The assembly was immersed in a 25 gallon coating tank to a depth of 10 inches (so that the sandwich portion of the panel is covered) in fresh uncontaminated electrocoat primer (PPG gray cathodic). The electrodes were connected to the power source and the panels were coated at 240 volts for 90 seconds. When the electrocoating process was concluded, the panels were carefully removed and rinsed with water and air blown (caution must be exercised so as not to dislodge the cover panel allowing the coating oil to be rinsed away). The panels were then baked in a horizontal position at 325° F. for 20 minutes. Upon removal from the oven the cured panels were visually inspected for the presence of indents or craters on the paint film and rated using the previously described scale. Seven tests were run using the above prepared coating oil;

3 panels showed no defects (rated 5)
3 panels showed minor defects (rated 4)
1 panel showed heavy defects (rated 2)

Seven tests were also run using the commercially available coating oil:

2 panels showed no defects (rated 5)
1 panel showed minor defects (rated 4)
4 panels showed heavy defects (rated 2, 2, 1, and 0)

EXAMPLES II and III

Two coating oils were prepared in accordance with Example I except that the amount of the di-isodecyl o-phthalate was varied. The compositions were as follows:

| | Parts | |
|---|---|---|
| | Ex. II | Ex. III |
| Sodium Sulfonate/Calcium Oxidate Ester Blend | 8 | 8 |
| 105 SUS Naphthenic Oil | 90 | 88 |
| Di-isodecyl o-phthalate | 2 | 4 |

Both products were evaluated in the soak and coat and sandwich tests for electrocoat compatibility. The coating oil of Example II and the coating oil of Example III had ratings of 4 in both parts of the Fisher TM55-55 test. Furthermore, both products exhibited good corrosion protection -comparable to the product of Example I. When the di-isodecyl o-phthalate was omitted from the formulation, i.e., a blend of 92 parts naphthenic oil and 8 parts sulfonate/oxidate ester was prepared, the resulting oil gave a rating of 1 in the soak and coat test and was therefore not tested in the sandwich test.

EXAMPLE IV

To demonstrate the ability to vary the coating oil composition a blend of the following components was prepared:

| | Parts |
|---|---|
| Sodium Sulfonate | 4 |
| Calcium Oxidate Ester | 4 |
| 150 SUS Paraffinic Oil | 64 |
| 105 SUS Mineral Seal Oil (Paraffinic) | 25 |
| Di-isodecyl o-phthalate | 3 |

The coating oil exhibited excellent rust and corrosion protection and when evaluated for primer compatibility in the Elpo test gave a rating of 5 in the soak and coat test.

EXAMPLE V

To demonstrate further compositional variation, the following ingredients were blended:

| | Parts |
|---|---|
| Barium Sulfonate | 4 |
| Calcium Oxidate Ester | 4 |
| 105 SUS Mineral Seal Oil (Paraffinic) | 89 |
| Di-isodecyl o-phthalate | 3 |

This product gave comparable test results to the product of Example IV in spite of its somewhat lower viscosity.

EXAMPLES VI-IX AND COMPARISONS I-V

To demonstrate the ability to prepare an effective coating oil with excellent primer compatibility using alkyl esters of a dicarboxylic acid and an alkyl ester of a mono-carboxylic aromatic acid coating oils were prepared and evaluated using the soak and coat test. To demonstrate the criticality of dicarboxylic and mono-nuclear aromatic esters to the primer compatibility of these formulations, a variety of comparable formulations were prepared using other esters commonly included in metal working products and other alcohols, glycols and glycol ethers. These comparative products were also evaluated in the soak and coat test. Compositions for Examples VI-IX and Comparisons I-V and the soak and coat test results for each are set forth in Table II.

It is apparent from the test results that excellent primer compatibility is obtained with the coating oils prepared using the esters of the dicarboxylic acid or mono-nuclear aromatic acid whereas when the fatty acid esters commonly used in metalworking formulations are used for the preparation of the coating oils totally unacceptable primer compatibility is obtained in the soak and coat test. Similarly it is demonstrated that use of an alcohol, glycol or glycol ether which is not esterified also provides coating oils having unacceptable primer compatibility.

TABLE II

| | Parts | | | | | | | | |
|---|---|---|---|---|---|---|---|---|---|
| | Ex VI | Ex VII | Ex VIII | Ex IX | Comp. I | Comp. II | Comp. III | Comp. IV | Comp. V |
| ALOX 2278 | 8 | 8 | 8 | 8 | 8 | 8 | 8 | 8 | 8 |
| 105 SUS Naphthenic Oil | 89 | 87 | 87 | 89 | 89 | 89 | 89 | 89 | 89 |
| Di-octyl Adipate | 3 | 5 | — | — | — | — | — | — | — |
| Di-(mixed $C_{7-9}$) Adipate | — | — | 5 | — | — | — | — | — | — |
| Ethyl Benzoate | — | — | — | 3 | — | — | — | — | — |
| Methyl Tallowate | — | — | — | — | 3 | — | — | — | — |
| Butyl Stearate | — | — | — | — | — | 3 | — | — | — |
| Tridecyl Alcohol | — | — | — | — | — | — | 3 | — | — |
| Ethylene Glycol | — | — | — | — | — | — | — | 3 | — |
| Diethylene Glycol | — | — | — | — | — | — | — | — | 3 |
| Soak and Coat Test Rating | 5 | 5 | 4 | 4 | 0-1 | 0-1 | 0-1 | 0-1 | 0-1 |

EXAMPLE X

A coating oil containing 8 parts sodium sulfonate/calcium oxidate blend, 87 parts 105 SUS naphthenic oil and 5 parts tri-isodecyl trimellitate was prepared. The resulting blend was evaluated in the soak and coat test and exhibited good electrocoat compatibility (rating of 4).

EXAMPLE XI

To demonstrate an even further variation of the organic ester component in the formulation of coating oils of the present invention, 1 part di-ethyl o-phthalate, 8 parts ALOX 2278 and 91 parts 105 SUS naphthenic oil were blended and evaluated for primer compatibility in the Fisher TM55-55 soak and coat test and gave a rating of 5. The coating oil also exhibited excellent rust and corrosion protection when evaluated in the Fisher TM52-29 test.

I claim:

1. A coating oil composition having improved electrocoat compatibility comprising (a) 2 to 10 weight percent oil-soluble Group IA alkali metal or Group IIA alkaline earth metal petroleum sulfonate; (b) 2 to 10 weight percent of a partially neutralized oxygenated hydrocarbon; (c) 0.5 to 6 weight percent of an organic acid ester selected from esters of mono-nuclear aromatic acids having from 1 to 3 carboxyl groups and esterified with a mono-functional aliphatic alcohol having from 1 to 20 carbon atoms and esters of short-chain aliphatic dicarboxylic acids having from 4 to 10 carbon atoms and esterified with a mono-functional aliphatic alcohol having from 1 to 12 carbon atoms; and (d) 80 to 95.5 weight percent inert, substantially sulfur-free hydrocarbon oil having 100° F. viscosity of 50 to 500 SUS.

2. The coating oil composition according to claim 1 wherein (a) is a petroleum sulfonate of the formula $(C_nH_{2n-10}SO_3)_xMe$ where Me is lithium, sodium potassium, calcium or barium, n is an integer greater than 20, and x is 1 or 2 and equal to the valence of Me, and (b) is a calcium or barium soap.

3. The coating oil composition according to claim 2 wherein (d) is a naphthenic or paraffinic oil having a viscosity of 75 to 350 SUS.

4. The coating oil according to claim 3 comprising 2.5 to 6 weight percent (a); 2.5 to 6 weight percent (b); 1 to 5 weight percent (c); and 85 to 92 weight percent (d).

5. The coating oil according to claim 4 wherein (a) is the barium salt of dinonylnaphthalene sulfonic acid or the neutralized salt of barium dinonylnaphthalene sulfonic acid.

6. The coating oil according to claim 5 wherein (b) contains from 0.8 to 48.8 weight percent calcium or barium and has an acid number from 0.1 to 60.

7. The coating oil according to claim 6 wherein (d) is a 101 SUS naphthenic oil.

8. The coating oil according to claims 1, 2, 3, 4, 5, 6 or 7 wherein (c) is an ester derived from a mono-nuclear aromatic acid selected from benzoic acid, p-phthalic acid and trimellitic acid and an aliphatic alcohol having 2 to 13 carbon atoms or an ester derived from an aliphatic dicarboxylic acid having from 6 to 9 carbon atoms and an aliphatic alcohol having from 6 to 10 carbon atoms.

9. The coating oil according to claim 8 wherein (c) is a $C_{2-13}$ alkyl o-phthalate and is present from 1 to 4 weight percent.

10. The coating oil according to claim 9 wherein (c) is di-isodecyl o-phthalate.

11. The coating oil according to claim 8 wherein (c) is a $C_{6-10}$ alkyl adipate and is present from 2 to 5 weight percent.

12. A coating oil composition having improved electrocoat compatibility comprising (a) 6 to 10 weight percent metal sulfonate/oxidate ester blend wherein the metal is sodium calcium, barium or mixtures thereof and the weight ratio of sulfonate to oxidate ranges from 2:1 to 1:2; (b) 10 to 4 weight percent $C_{2-13}$ alkyl ester of o-phthalic acid; and (c) 86 to 93 weight percent 75-350 SUS naphthenic or paraffinic oil.

13. The coating oil according to claim 12 wherein (a) is a sodium sulfonate/calcium oxidate ester blend.

14. The coating oil according to claim 13 wherein (b) is di-isodecyl o-phthalate.

15. A coating oil composition having improved electrocoat compatibility comprising (a) 6 to 10 weight percent metal sulfonate/oxidate ester b lend wherein the metal is sodium, calcium, barium or mixtures thereof and the weight ratio of sulfonate to oxidate ranges from 2:1 to 1:2; (b) 2 to 5 weight percent $C_{6-10}$ alkyl ester of adipic acid; and (c) 86 to 93 weight percent 75-350 SUS naphthenic or paraffinic oil.

16. The coating oil according to claim 15 wherein (a) is a sodium sulfonate/calcium oxidate ester blend.

17. The coating oil according to claim 16 wherein (b) is di-octyl adipate.

18. The coating oil according to claim 16 wherein (b) is di-(mixed $C_{7-9}$) adipate.

19. A metal workpiece resistant to rust and corrosion having applied to its surface the coating oil composition of claim 1.

* * * * *